US005742220A

United States Patent [19]

Scherer

[11] Patent Number: 5,742,220

[45] Date of Patent: Apr. 21, 1998

[54] HANDLING TOOL FOR OVERHEAD-MOUNTED DEVICES

[75] Inventor: Henry W. Scherer, Gurnee, Ill.

[73] Assignee: S&C Electric Company, Chicago, Ill.

[21] Appl. No.: 404,686

[22] Filed: Mar. 15, 1995

[51] Int. Cl.[6] ..... H01H 71/10; B25B 23/16

[52] U.S. Cl. ..... 337/171; 81/53.1; 294/19.1

[58] Field of Search ..... 81/53.1, 53.11, 81/53.12; 29/758; 294/19.1, 19.3, 26, 92, 103.1; 337/171

[56] References Cited

U.S. PATENT DOCUMENTS

| | | | |
|---|---|---|---|
| Re. 20,737 | 5/1938 | Kehl | 81/53.1 |
| 1,370,651 | 3/1921 | Johnson . | |
| 2,299,838 | 10/1942 | Mays | 81/53.1 |
| 2,316,204 | 4/1943 | Williams | 81/53.1 |
| 3,433,521 | 3/1969 | Lasko | 294/26 |
| 4,230,357 | 10/1980 | Bosch | 294/19.1 |

OTHER PUBLICATIONS

"S&C Handling Tools", Des. Bulletin 851–30, Jan. 22, 1990, p. 1.

"S&C Handling Tools", Des. Bulletin 791–30, Jan. 26, 1970, p. 4.

Catalog Sheet F–2, Hastings Fiber Glass Products Inc, 1985.

Universal Tool Accessories, Catalog Sheet, Nov. 1987, A.B. Chance Co.

Pp. 24–14, "Lineman's and Cableman's Handbook", 1992, McGraw–Hill.

*Primary Examiner*—Leo P. Picard

*Assistant Examiner*—Jayprakash N. Gandhi

*Attorney, Agent, or Firm*—James V. Lapacek

[57] ABSTRACT

A handling-tool fitting is provided for use in the removal and installation of overhead mounted devices in power distribution and transmission circuits, the handling-tool fitting including a curled prong having a first, substantially straight portion and a second, cured portion that is inclined upwardly with respect to the first portion. The handling-tool fitting is inserted through a loop of the device, the loop being supposed in a stable manner on the first portion of the handling-tool fitting and the second portion preventing any movement of the loop of the device away from the first portion.

8 Claims, 6 Drawing Sheets

HANDLING TOOL FOR OVERHEAD-MOUNTED DEVICES

BACKGROUND OF THE INVENTION

1. Field of the Invention

The present invention relates generally to the field of handling tools and more particularly to an improved handling-tool fitting which provides increased stability and accuracy in handling overhead mounted devices, e.g. fuses, cutouts, etc., utilized in overhead power distribution and transmission circuits and which are removable from overhead mountings.

2. Description of the Related Art

According to one common definition used by those skilled in the art, the term handling tool includes a handling-tool fitting affixed to or otherwise carried by a pole or hot stick. For simplicity, as used in this application, the term handling tool will be used to refer to either a complete handling tool or a handling-tool fitting. Various handling tools are known for handling overhead mounted devices where the handling tools are utilized to manipulate the overhead devices with respect to their mountings, e.g. removal from or installation in their mountings. For example, a number of diverse handling tools are shown in the following manufacturers' literature: S&C Descriptive Bulletins 851-30, Jan. 22, 1990, and 791-30, Jan. 26, 1970 (S&C Electric Co., Chicago, Ill.), Catalog Sheet F-2 on Accessories (1985, Hastings Fiber Glass Products, Inc., Hastings Mich.), and Chance Universal Tool Accessories catalog sheet (November 1987, A.B. Chance Co., Centralia, Mo.). One particular type of handling tool, known as a spiral disconnect includes a curved hook portion. This particular variety is exemplified by Part No. M4455-79 by A.B. Chance, Cat. No. A10042 by Hastings, and Catalog No. 4403 (in the 791-30 publication). Another example of this spiral disconnect is shown in U.S. Pat. No. Re. 20,737 and described as a helical involute form. An assortment of hot-line tools is shown at page 24-14 of the Eighth Edition of the "Lineman's and Cableman's Handbook" (1992, McGraw-Hill). The following U.S. Patent Nos. are directed to handling tools for manipulating overhead devices: U.S. Pat. Nos. 1,840,150; 2,299,838; 2,379,433; 2,936,193; 3,026,391; 3,868,136; 4,132,441; 4,321,575. Other types of tools for manipulating overhead lines and for performing mechanical operations or tasks are shown in the following U.S. Pat. Nos.: 3,111,049; 3,433,521; 3,627,367; 3,788,691; 3,666,311; 4,230,357; 4,242,930; 4,470,328; and 4,965,930.

In one common application in the electrical power distribution and transmission field, the handling tools are used to manipulate cutouts, fuses and other similar devices, e.g. as shown in U.S. Pat. No. 4,414,527 and on page 1 of the S&C Descriptive Bulletin 851-30. Specifically, the handling tool is used to remove or insert a device from its mounting. Typically, these devices are hingedly carried with respect to their respective mountings and many also move to a drop-out position after the device has operated to interrupt the circuit.

The devices typically include one or more structural features or fittings that are designed for cooperation with corresponding features of the handling tools which include fingers, prongs, clamps or cradles. For example, one typical handling feature of a device is a pull ring (see reference number 54 of FIG. 3 of U.S. Pat. No. 4,414,527). Via the manipulation of a prong or finger of a handling tool that is inserted through an aperture of the pull ring, a fuse tube of a cutout may be pivoted between opened and closed positions with respect to the cutout mounting. Additionally, conventional fuse tubes for fuse and cutout mountings typically include provisions at their lower fittings such as a loop or band for the passage of a prong (which is dimensioned per ANSI Standards) to aid in the removal and insertion of the fuse tube with respect to the mounting.

To insert the fuse tube into its mounting, a specific portion or prong of the handling tool is inserted through the loop or band of the lower fitting of the fuse tube and the device is lifted via the pole of the handling tool to the vicinity of the overhead mounting and appropriately placed therein. In many circumstances, this operation can require both strength and dexterity since the mounting can be located as much as 30 feet above the operator. Further, even relatively moderate wind conditions cause additional difficulty. While a certain degree of skill and strength is necessitated merely by the weight of the fuse tube at the end of the pole and the need for accurate placement in the mounting, the design and orientation of the handling tool also affects the handling and operation as well as the force experienced by the operator. In the case of many available handling tools, the task is exacerbated and the operator experiences additional forces on the pole as the operator is required to change the orientation of the pole and handling tool to perform the task.

While it would be desirable to merely require the operator to attach the handling tool to the fuse tube fitting, lift the fuse tube out of the mounting, and lower the fuse tube to the ground, the operation often times requires additional manipulations to maintain the proper orientation to retain the fuse tube on the handling tool and the operator experiences undesirable forces caused by the awkward orientation of the fuse tube with respect to the handling tool in order to maintain control of the fuse tube and retain it on the handling tool, i.e. to avoid the fuse tube slipping off the handling tool and falling. The same difficulties may be experienced as the fuse tube is being raised to the mounting with the fuse tube being in an undesirable orientation with respect to the operator so as to place an undue burden on the operator to avoid the fuse tube slipping off the handling tool. Thus, conventional handling tools do not maintain appropriate balance and orientation of the fuse tube on the handling tool which results in undesirable forces to the operator as the operator is required to compensate for the unbalance.

In view of the foregoing, while the handling tools of the prior art may be generally suitable for their intended uses, it would be desirable to provide a handling tool that improves stability and accuracy of manipulating a device with respect to an overhead mounting while not increasing the balancing and manipulating forces presented to the operator. Additionally, some new types of overhead devices have diverse geometries and centers of gravity that are more distant from the point of attachment to the handling-tool fitting than previous devices. This amplifies the shortcomings of previous handling tools and increases the difficulty of handling operations.

SUMMARY OF THE INVENTION

Accordingly, it is a principal object of the present invention to provide an improved handling-tool fitting which improves the stability of removing and inserting devices with respect to their overhead mountings and that requires less effort and manipulation on the part of operators.

It is another object of the present invention to provide a handling-tool fitting including a curled prong having a first portion that is substantially straight and a second portion adjacent the first portion that includes a curved section that is slightly inclined upwardly with respect to the first portion.

These and other objects of the present invention are efficiently achieved by a handling-tool fitting for use in the removal and installation of overhead mounted devices in power distribution and transmission circuits, the handling-tool fitting including a curled prong having a first, substantially straight portion and a second, curved portion that is inclined upwardly with respect to the first portion. The handling-tool fitting is inserted through a loop of the device, the loop being supported in a stable manner on the first portion of the handling-tool fitting and the second portion preventing any movement of the loop of the device away from the first portion.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
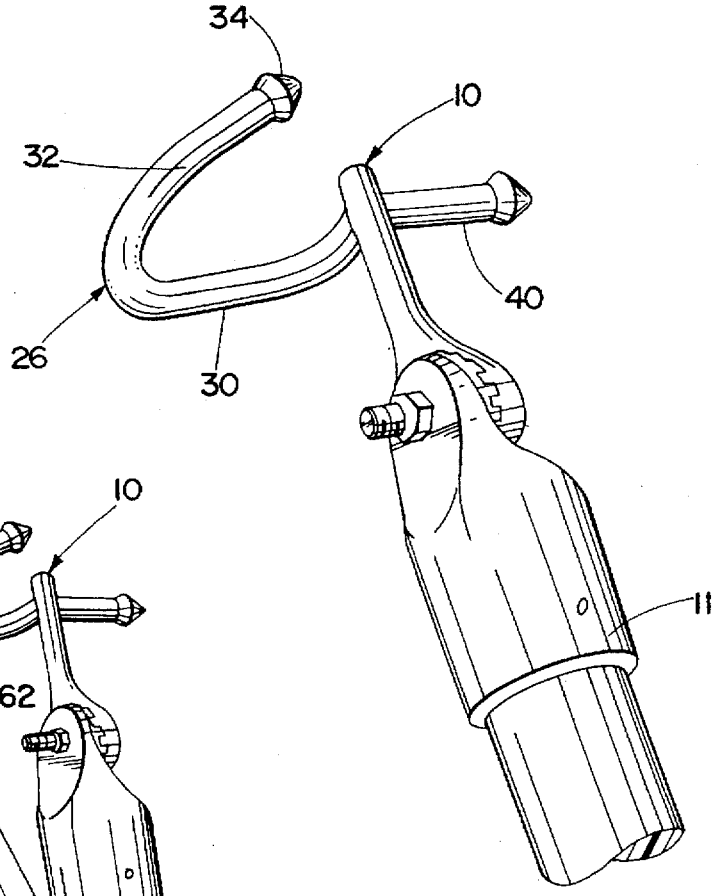
FIG. 1 is a perspective view of the handling tool according to the present invention.
Figure 2:
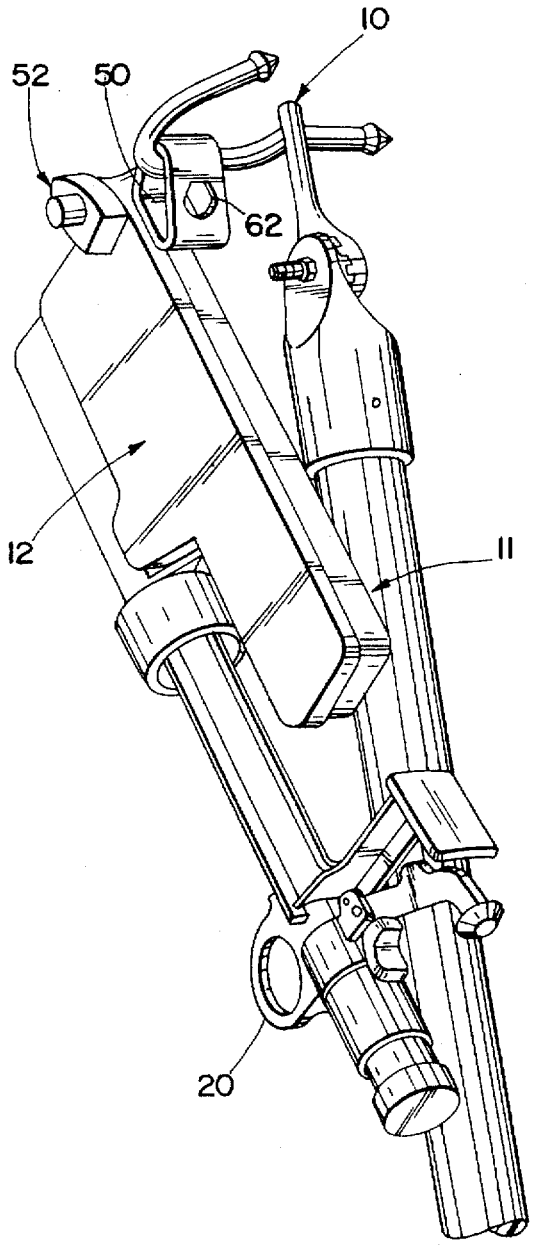
FIG. 2 is a perspective view of the handling tool of FIG. 1 supporting a fuse limiter for insertion or removal with respect to an overhead-mounted position.
Figure 3:
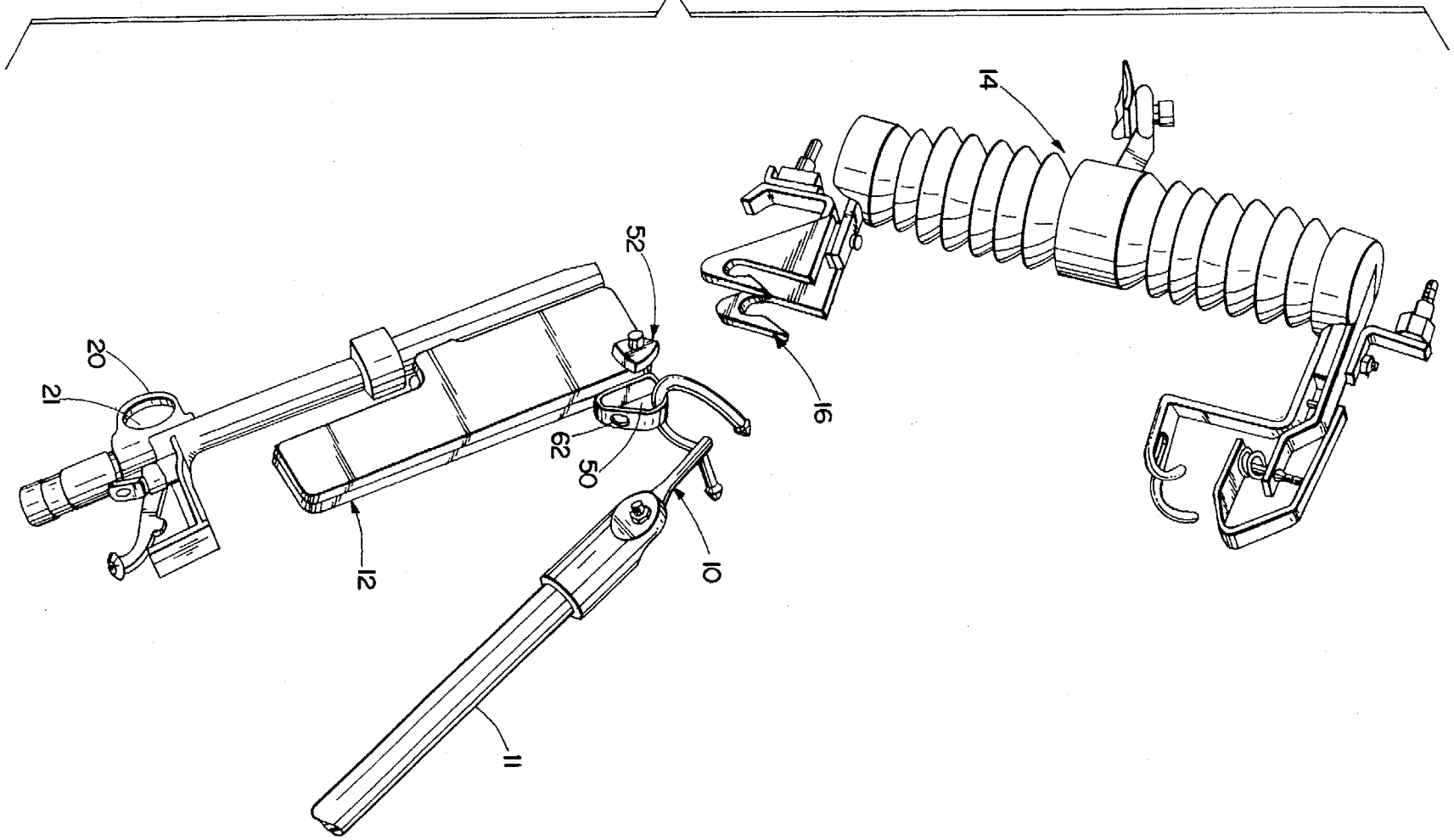
FIG. 3 is a perspective view of the handling tool of FIGS. 1 and 2 and illustrating an intermediate handling position of insertion or removal with respect to the illustrated mounting for the fuse limiter.
Figure 4:
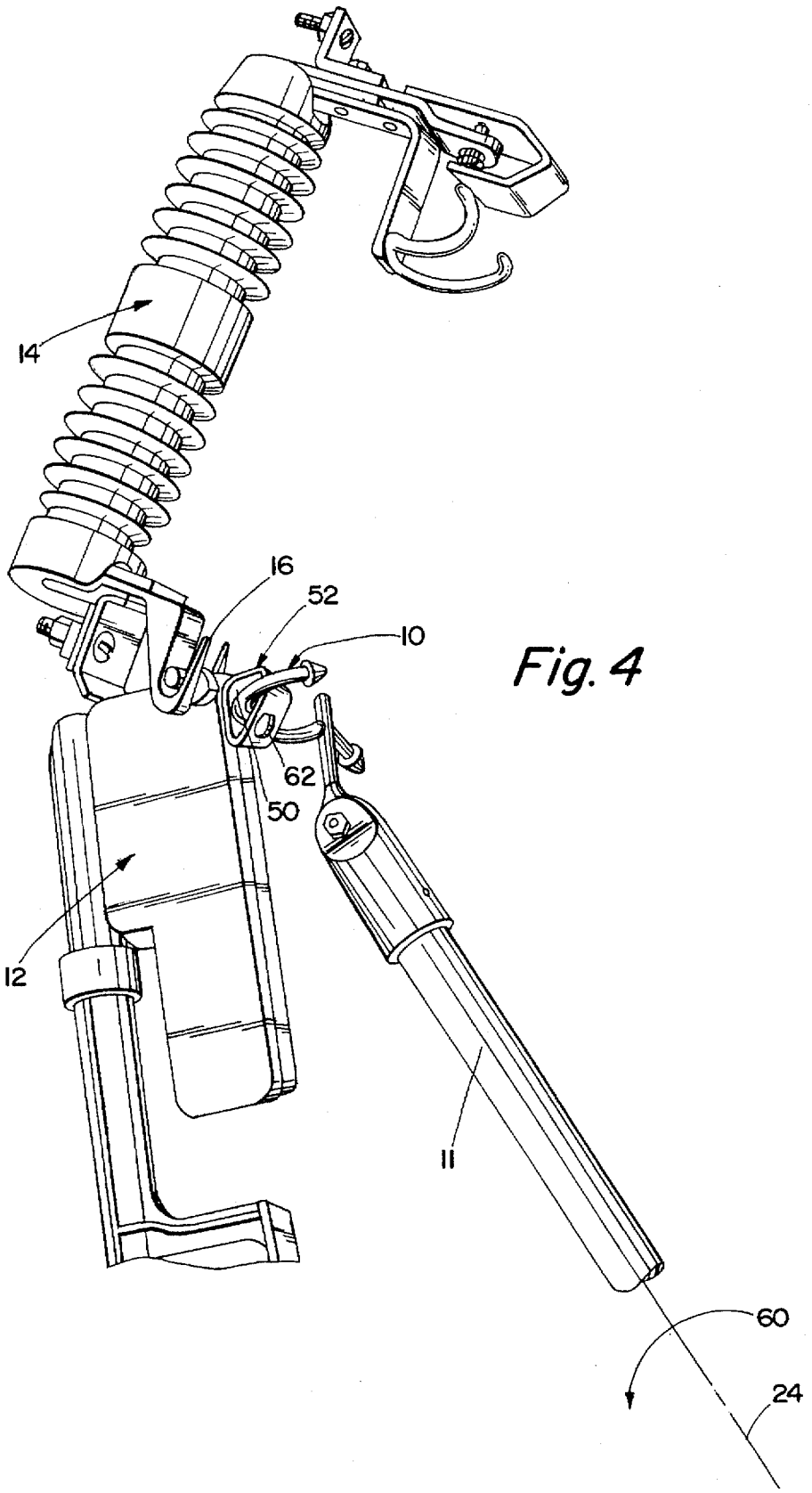
FIG. 4 is a perspective view of the handling tool of FIGS. 1–3 and illustrating a handling position during either the insertion or removal of the fuse limiter with respect to its mounting where a trunnion of the fuse limiter is in a hinge of the mounting with a portion of the handling tool inserted through the trunnion.

Referring now to FIGS. 1–5, the handling-tool fitting 10 of the present invention carded by a universal pole 11 or the like facilitates the insertion and removal of a device such as the fuse limiter 12 illustrated in FIGS. 2–5 with respect to a mounting 14 which is located in an overhead position. The mounting 14 is representative of a conventional cutout mounting, for example as illustrated in U.S. Pat. No. 4,414,527. The sequence of FIGS. 3–4 illustrates how the handling-tool fitting 10 of the present invention is utilized to lift the fuse limiter 12 up and into the mounting 14 and insert the fuse limiter 12 into the hinge 16 of the mounting 14. With the fuse limiter 12 in the position of FIG. 4, the handling-tool fitting 10 is then used to engage a pull ring 20 of the fuse limiter 12 and to move the fuse limiter 12 from the position of FIG. 4 through the position of FIG. 5 and into a closed position in the mounting 14 (for example, as shown in FIG. 1 of copending application Ser. No. 08/227,202 filed on Apr. 7, 1994 in the name of H. W. Scherer et al now U.S. Pat. No. 5,502,427). The sequence of FIG. 4 to FIG. 3 represents and illustrates the removal of the fuse limiter 12 from the mounting 14 and the lowering of the fuse limiter 12 and the handling-tool fitting 10 from the overhead position of the mounting 14 to the level of the operator, e.g. on the ground or in a bucket truck.

With additional reference to FIGS. 6–9, the handling-tool fitting 10 includes an attachment portion 22 for affixing to the universal pole 11 and a generally curled prong 26 that is substantially defined in a plane generally perpendicular to an axis 24 defined by the attachment portion 22 and generally along the affixed universal pole 11. The curled prong 26 includes a first portion 28 that is generally straight and extends at approximately a right angle to the axis 24, a second generally straight portion 30 extending at approximately a right angle to the first portion 28, and a third portion 32 that extends from the second portion 30 and is generally curved around and toward the attachment portion 22 and inclined with a predetermined degree of rise defined by an angle "a" with respect to the second portion 30. In a preferred embodiment, the angle "a" is approximately 15 degrees. The inclination of the third portion 32 is effective to prevent the fuse limiter 12 from moving away from the second portion 30 while the operator lowers or raises the fuse limiter 12, thus ensuring that the orientation of the fuse limiter 12 does not change with respect to the handling-tool fitting 10. This stability of the fuse limiter 12 with respect to the handling-tool fitting 10 ensures that there is no undue strain or turning forces experienced by the operator. The third portion 32 ends with a widened, conical tip 34 so as to define a predetermined opening or expanse 36 between the tip 34 and the attachment portion 22. The first portion 28 is provided so as to space the fuse limiter 12 away from the pole 11. The handling-tool fitting 10 also includes a straight prong 40 having a widened, conical tip 41 (which are each dimensioned according to ANSI Standards for distribution switch sticks) that extends at approximately a right angle to the axis 24 and opposite to the curled prong 26. The straight prong 40 is useful for the closing of devices after the curled prong 26 has been utilized to insert the fuse limiter 12 into the mounting 14.

Considering now a more detailed discussion of inserting the fuse limiter 12 into the mounting 14, the tip 34 of the curled prong 26 of the handling-tool fitting 10 is inserted, via rotation of the curled prong 26, through a loop 50 of a trunnion 52 of the fuse limiter 12 until the second portion 30 rests against the expanse of the loop 50 as shown in FIG. 2. The third portion 32 maintains the fuse limiter 12 on the second portion 30, the second portion 30 ensuring that the fuse limiter 12 is carried and supported by the handling-tool fitting 10 such that no strain or turning forces are experienced by the operator, i.e. due to the aligned position of the device 12 that is maintained since there is no tendency of the fuse limiter 12 to twist or turn with respect to the handling-tool fitting 10. The fuse limiter 12 is then lifted up to the mounting 14 as shown in FIG. 3 whereupon the trunnion 52 of the fuse limiter 12 is positioned into the hinge 16 of the mounting 14 as shown in FIG. 4. With the fuse limiter 12 inserted into the mounting 14, the curled prong 26 of the handling-tool fitting 10 is easily removed from the loop 50 by rotation of the pole 11 and handling-tool fitting 10 in the direction indicated at 60 in FIG. 4. The fuse limiter 12 may then, if desired, be moved to the closed position in the mounting 14 by use of the straight prong 40 of the handling-tool fitting 10. This is accomplished by inserting the prong 40 through an aperture 21 of the pull ring 20 and pivoting the fuse limiter 12 from the position of FIG. 4 through the position of FIG. 5 to a closed position (e.g. as shown in FIG. 1 of the aforementioned copending application Ser. No. 08/227,202).

Figure 5:
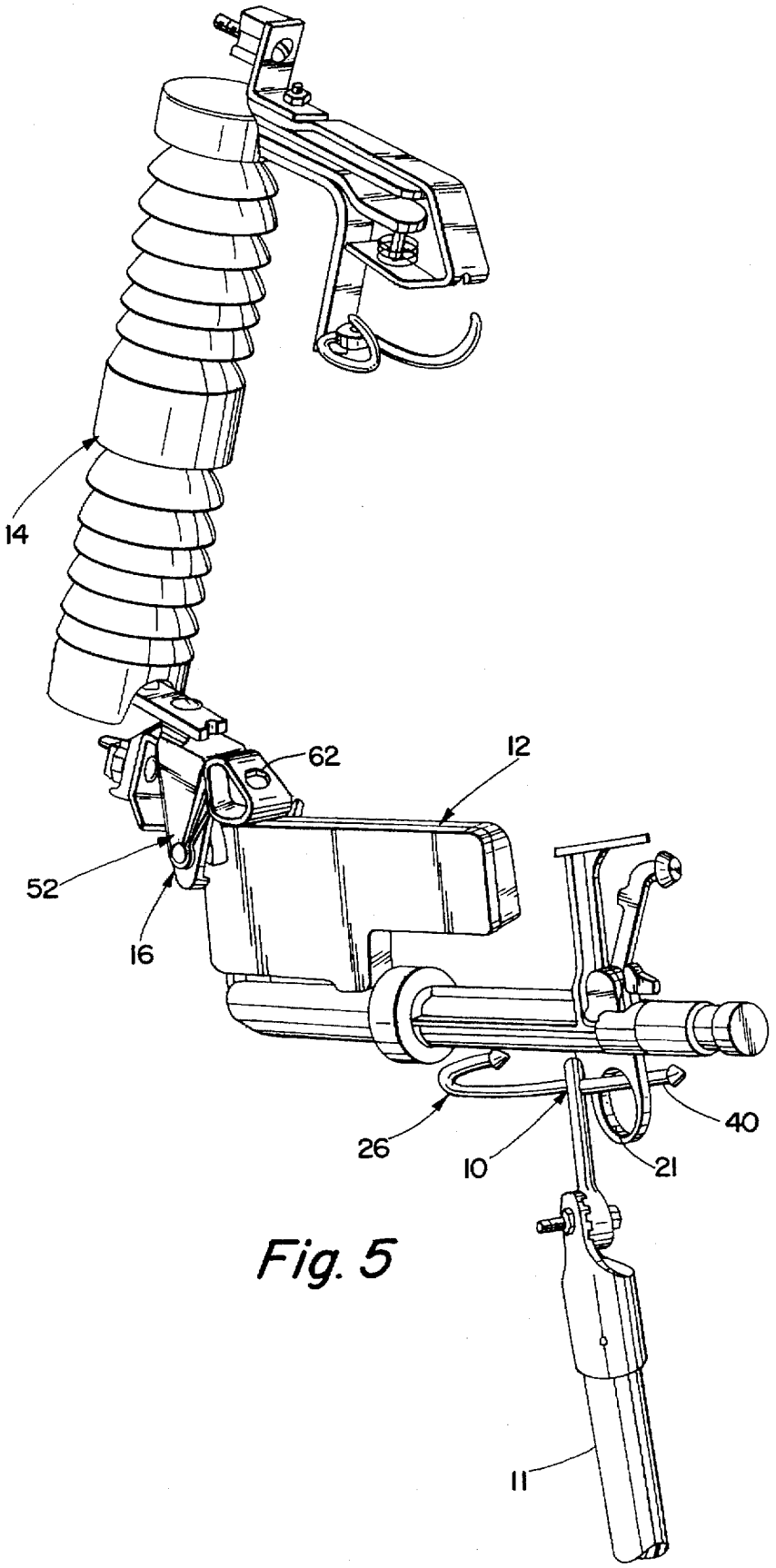
FIG. 5 is a perspective view of the handling tool of FIGS. 1–4 with the fuse limiter in a partially closed position which can also be characterized as a partially open position.
Figure 6:
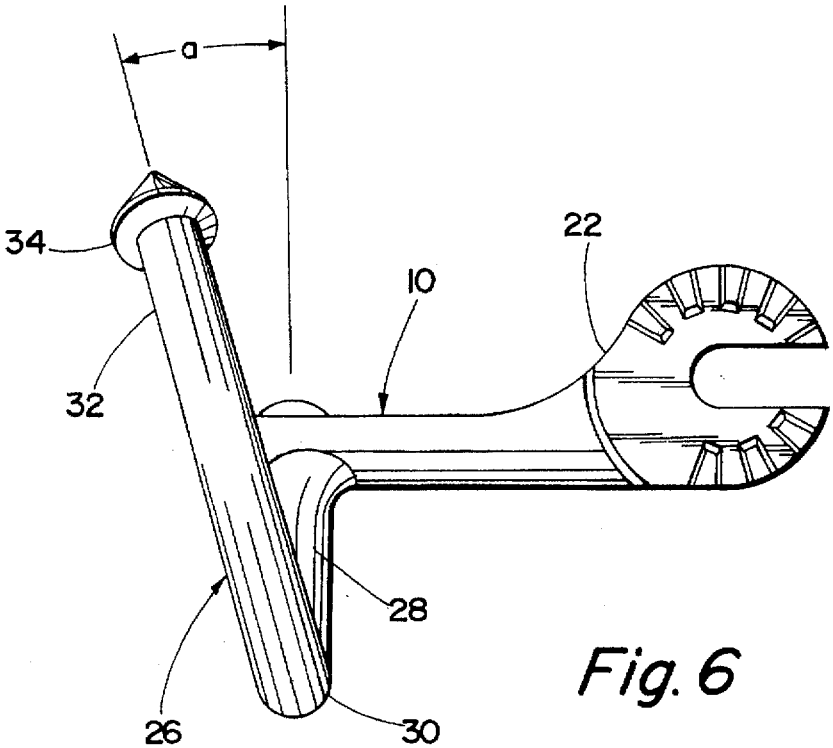
FIGS. 6, 7 and 8 are respective front, right-side, and top elevational views of the handling tool of FIGS. 1–5.
Figure 7:
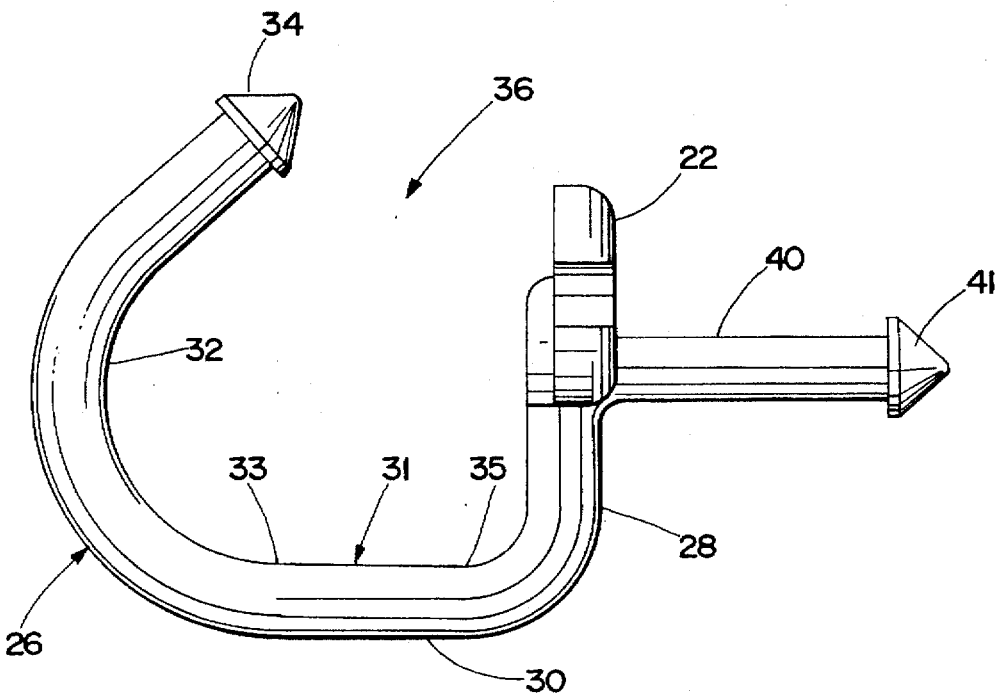

Similarly, the operator can open the fuse limiter 12 from the closed position and pivot the fuse limiter 12 through the position of FIG. 5 to the position of FIG. 4. Then if it is desired to remove the fuse limiter 12 from the mounting 14, the tip 34 of the handling-tool fitting 10 is inserted through the loop 50 and the handling-tool fitting 10 is rotated to the position shown in FIG. 4 so that the second portion 30 is through the loop 50. In the position as shown in FIG. 4, the fuse limiter 12 may then be lifted up and out of the hinge 16 of the mounting 14 and lowered through the position shown in FIG. 3. It should be noted that the angle of attachment of the handling-tool fitting 10 with respect to the pole 11 is different in FIG. 4 than in FIGS. 1–3. This illustrates the difference in attachment angles in accordance with the position of the operator with respect to the mounting 14. For example, where the angle of the pole 11 with respect to the mounting 14 is lower as in FIG. 4, the handling-tool fitting 10 is adjusted with respect to the pole 11 such that it forms approximately the same angle with respect to the mounting 14 as it does in FIG. 3. where the angle of the pole 11 with respect to the mounting 14 is greater. Accordingly, the angle of attachment to the pole 11 may be changed to provide the most desirable and comfortable handling characteristics.

Figure 8:
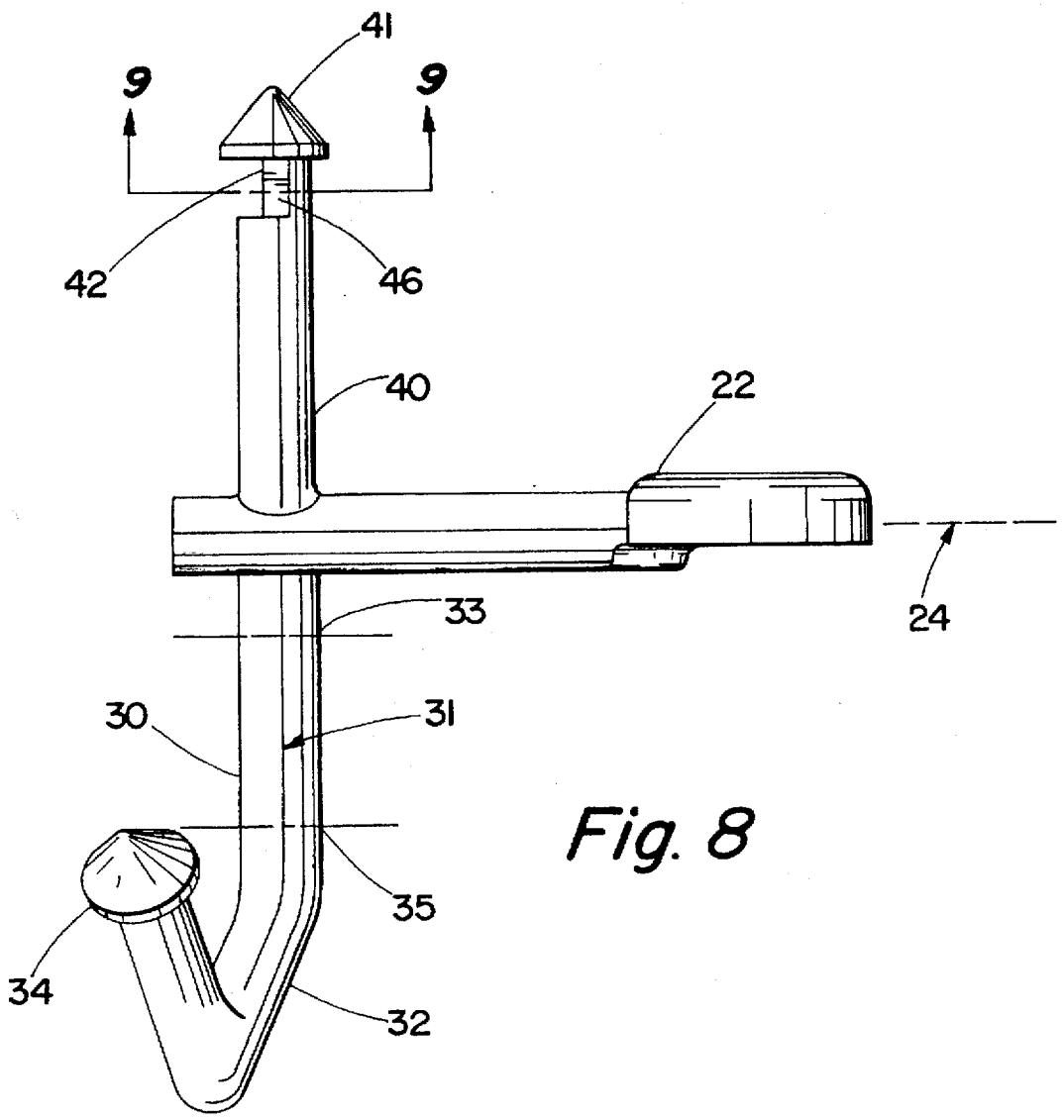
Figure 9:
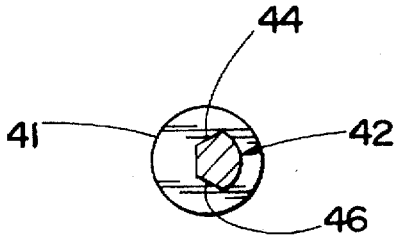
FIG. 9 is a view, partly in section, taken along the line 9—9 of FIG. 8.

In accordance with additional features of the handling-tool fitting 10 of the present invention and referring again to FIGS. 6–9, the second portion 30 includes a flat, planar surface 31 from a point 33 to a point 35 (see FIGS. 7 and 8) that is arranged to engage the inner expanse of the loop 50 of the trunnion 52 so as to minimize "rocking" (i.e. pivoting and swaying) of the fuse limiter 12 about the handling-tool fitting 10. It should be noted that the expanse or extent of the second portion 30 is at least equal to the width of the loop 50 of the trunnion 52 which is engaged by the second portion 30. For situations where the operator is removing or installing the fuse limiter and must work from a location to the side of the mounting 14 (e.g. when reaching sideways from a pole to outside phases), the operator inserts the straight prong 40 through a keyhole opening 62 of the loop 50 of the trunnion 52. In accordance with important aspects of the present invention, a section 42 of the prong 40 is provided with planar surfaces 44 and 46 as illustrated in FIGS. 8 and 9. This feature aids in retaining the trunnion 52 with respect to the prong 40 and reduce the possibility of the trunnion 52 moving over the tip 41 of the straight prong 40 during the insertion or removal manipulation, including the raising or lowering of the fuse limiter 12 with respect to the mounting 14 as shown in FIGS. 3 and 4.

With the handling-tool fitting 10 of FIGS. 1–9, it has been found that fuses, cutouts and fuse limiters may be easily and quickly removed from or inserted into overhead mountings. Additionally, two or three devices may be carried on the curled prong 26 of the handling-tool fitting 10 at the same time, such that three devices may be removed from or inserted into their mountings without lowering the pole 11 for each device.

While there has been illustrated and described a preferred embodiment of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A handling-tool fitting for devices having a handling loop of predetermined width, the handling tool comprising a first portion including means for attachment to a pole and defining an axis, a second portion of generally circular cross-section extending from said first portion and including a substantially straight section having an orientation that is substantially perpendicular to said axis and having an expanse that is at least equal to the predetermined width of the handling loop, and a third portion of generally circular cross-section extending from said second portion and including a section defined by a curvature and an angle of inclination with respect to said second section, said curvature being inward with respect to said second section and said angle of inclination being upward with respect to said second portion and said first portion.

2. A handling-tool fitting comprising a first portion including means for attachment to a pole and defining an axis, a second portion of generally circular cross-section extending from said first portion and including a substantially straight section having an orientation that is substantially perpendicular to said axis, and a third portion of generally circular cross-section extending from said second portion and including a section defined by a curvature and an angle of inclination with respect to said second section being inward with respect to said second section and said angle of inclination being upward with respect to said second portion and said first portion, said handling-tool fitting further comprising a straight prong extending from said first portion and generally opposite to said second portion.

3. The handling-tool fitting of claim 2 wherein said third portion and said straight prong each includes a widened conical tip.

4. The handling-tool fitting of claim 3 wherein said widened tip of said straight prong includes predetermined planar surfaces.

5. A handling-tool fitting comprising a first portion including means for providing predetermined attachment features and defining an axis, a generally cuffed prong that is substantially defined in a plane generally perpendicular to said axis, said generally curled prong including a first section that is generally straight and that extends at approximately a right angle to said axis, a second generally straight section extending at approximately a right angle to said first section, and a third section extending from said second section and being generally curved around and toward said first section and being inclined with a predetermined degree of rise with respect to said second section.

6. The handling-tool fitting of claim 5 wherein said generally curled prong has a generally circular cross-section.

7. The handling-tool fitting of claim 6 wherein said second section has a planar surface.

8. The handling-tool fitting of claim 7 wherein said planar surface is generally perpendicular to said plane and is located along the inner side of said generally curled prong.

* * * * *